United States Patent [19]

Laures

[11] Patent Number: 4,625,647

[45] Date of Patent: Dec. 2, 1986

[54] WEAPON SYSTEM AND MISSILE FOR THE STRUCTURAL DESTRUCTION OF AN AERIAL TARGET BY MEANS OF A FOCUSSED CHARGE

[75] Inventor: Pierre Laures, Chatenay-Malabry, France

[73] Assignee: Societe Nationale Industrielle et Aerospatiale, Paris, France

[21] Appl. No.: 712,388

[22] Filed: Mar. 15, 1985

[30] Foreign Application Priority Data

Apr. 13, 1984 [FR] France ..... 84 05913

[51] Int. Cl.[4] ..... F42C 13/00

[52] U.S. Cl. ..... 102/214; 102/211

[58] Field of Search ..... 102/211, 213, 214

[56] References Cited

U.S. PATENT DOCUMENTS 4,168,663 9/1979 Kohler ..... 102/214

4,232,609 11/1980 Held ..... 102/214

*Primary Examiner*—Charles T. Jordan

*Attorney, Agent, or Firm*—Marshall, O'Toole, Gerstein, Murray & Bicknell

[57] ABSTRACT

The invention relates to a weapon system intended for the structural destruction of a target. According to the invention, this system comprises computing means which are mounted on board said missile and which, from the values of the velocity Ve of the missile and of the relative target-missile velocity $V_R$, as well as from the angle D between the longitudinal axis of the missile and said relative velocity $V_R$, calculate at an instant close to said instant of detection furnished by proximity detection means, a duration which is then counted down by said computer means from said instant of detection and at the end of which said computer means control said focussed charge.

8 Claims, 8 Drawing Figures

WEAPON SYSTEM AND MISSILE FOR THE STRUCTURAL DESTRUCTION OF AN AERIAL TARGET BY MEANS OF A FOCUSSED CHARGE

The present invention relates to a weapon system intended for the structural destruction of an aerial target by means of a focussed charge and comprising a missile carrying said focussed charge.

It is known that the destruction of an aerial target, such as an attack missile, by direct impact of a defence missile is highly improbable, however sophisticated the system for guiding said defence missile is. The two principal methods by which a defence missile may destroy such an aerial target, by means of a conventional payload or warhead, at present employ:

- either the effect of blast of the explosion of said charge if the latter is considerable and if the target is in the immediate vicinity;
- or the projection, thanks to a considerable charge, of a largely open shower of splinters, in sensitive zones of the target.

These two conventional methods present the drawback of necessitating a considerable payload, with the result that the defence missiles that they employ present a relatively large mass which is detrimental to their manoeuvrability. This is all the more detrimental as the attack missiles are highly maneuverable and as it is therefore desirable for the maneuverability of a defence missile to be as high as possible to allow a highly manoeuvrable attack missile to be intercepted thereby.

To overcome this drawback of the conventional methods of interception, it has already been thought to project, from the defence missile and by means of a relatively weak charge, a focussed shower of splinters into a fragile zone of said target located in the immediate vicinity of said defence missile, to section said target into two distinct parts. Such a structural destruction of a target necessitates that a sufficient number of splinters together reach a small surface zone of the target and that the charge used be focussed, i.e. it projects, during the explosion, splinters of which the paths form a substantially constant angle with the axis of the missile.

Such a structural destruction allows the use of missiles of small dimensions carrying only a weak or average charge (of the order of three to four times weaker than that required by the first two effects mentioned above) and presenting considerable maneuverability, for example obtained by means of a control in force, i.e. with the aid of lateral nozzles of which the line of action passes at least approximately through the centre of gravity of the carrier missile.

The structural destruction would therefore appear to consitute the most effective method vis-à-vis rapid, highly maneuverable targets. However, it is not employed in practice, as it requires, for the interception to be successful, that the zone of impact of the focussed shower of splinters corresponds to a vulnerable zone of the target. It does not appear that the zone of impact, on a target, of the splinters of a focussed shower has, up to the present time, been mastered.

It is an object of the present invention to overcome this drawback.

The object of the present invention is to provide a weapon system for sending the splinters of a focussed charge into a zone of the target, specified in advance and selected for its vulnerability. For an aerial target, such a vulnerable zone corresponds for example to that part of the fuselage situated between the wings and the stabilizer.

To this end, according to the invention, the weapon system intended for the structural destruction of a target by means of a controlled focussed charge and comprising a missile carrying said focussed charge and provided with first means for furnishing the value of the velocity Ve of said missile, with second means for furnishing the value of the relative velocity $V_R$ of the target with respect to said missile, with third means for furnishing the angle D between the longitudinal axis of the missile and said relative velocity, and with fourth means for detecting proximity, adapted to indicate the instant of detection of one end of said target, is noteworthy in that it comprises computing means which are mounted on board said missile and which, from the values of the velocity of the missile and of said relative target-missile velocity, as well as from said angle between the longitudinal axis of the missile and said relative velocity, calculate at an instant close to said instant of detection, a duration which they count-down from said instant of detection of one end of the target and at the end of which they control said focussed charge.

It is thus seen that, according to the invention, the explosion of the focussed charge is controlled from said instant of detection of one end of the target, with a delay time which is calculated as a function of the real parameters of the interception of the target by the missile and which, in reality, corresponds to a predetermined length of said target from its end detected by said fourth means.

Consequently, the splinters of the focussed charge may reach the predetermined region of said target with a view to the successful structural destruction thereof. In the event of this calculated duration being zero or negative, firing would be effected immediately.

It will be noted that known missiles are generally provided with a system for releasing the charge actuated with a certain delay, after the detection of the target; however, in that case, this delay is provided by construction or possibly introduced during the launching of the missile, taking into account the supposed velocity of the target and the type of attack made by the missile on the target (attack from the front or the rear). On the other hand, according to the invention, the delay of explosion of the focussed charge is determined as a function of the circumstances of the interception, in order to optimalize the effects of said charge and to obtain structural destruction of the target.

Said first, second and third means are preferably provided to be able to furnish their information continuously and in that case said computing means calculate said duration continuously and furnish a series of values thereof, then, from said instant of detection furnished by said fourth means, count-down the last value of this duration available before said instant of detection.

As is known, known delays inherent in the system occur between firing and the explosion of the focussed charge, as well as in the detection of the target by the fourth means. If the totality of these known delays of construction is equal to To, said computing means calculate and count-down a duration $T1=T-To$ to take into account these delays and to allow the explosion at the end of time T, determined for the splinters of the focussed shower to reach a desired zone of the target.

In an advantageous embodiment of the system according to the invention, said computing means calculate the duration To from the following formulae:

$$T = \frac{d + |l_o \cos P|}{V_R \cos D} \text{ and } tg\, P = \frac{V_R \sin D}{V_R \cos D - Ve}$$

in which:

T=duration counted down from the instant of detection of one end of the target by said fourth means and at the end of which the explosion of the focussed charge is desired for its splinters to reach a predetermined vulnerable part of said target;

d=distance separating, along axis X—X of the missile, the centre F of the fourth proximity sensing means from the centre O of the focussed charge;

lo=constant, homogeneous to a length, characteristic of the target to be destroyed;

Ve=velocity of the missile;

$V_R$=relative velocity of the target with respect to the missile;

D=angle between the axis of the missile and $V_R$.

Said computing means then possibly correct the duration T by the value To of the inherent delays in order to furnish a firing signal upon expiration of duration $T_1$.

In order to be able to furnish the computing means with the constant lo, the system according to the invention comprises means adapted to indicate this constant. Such means may be display means actuated manually at the moment of launching of the missile. They are preferably constituted by automatic target recognition means either carried by the missile itself or disposed stationarily. In the latter case, these automatic recognition means are advantageously linked with the missile launching and guiding station, which transmits to said missile by electromagnetic waves the value of lo of the target to be destroyed, at the same time as the other usual data.

It will be noted that, at instants very close to interception, i.e. when the missile and the target pass through the same vertical, the relative velocity $V_R$ and the angle D between the axis of the missile and this relative velocity $V_R$ undergo rapid and insignificant variations: $V_R$ passes through a zero value and D passes through 90°. In this way, for the calculated delay of explosion $T_1$ to be significant, the measurements of Ve, $V_R$ and D must have been effected a certain time before interception, this time having to be neither too long nor too short for $V_R$ and D to represent substantially the real values despite the accelerations of the missile and of the target.

It results from this anticipated measurement that it is necessary for said computing means to elaborate a supplementary delay time t, which is counted down from the instant of the measurements Ve, $V_R$ and D, and of which the expiration allows the beginning of the countdown of the delay $T_1$ of firing, as soon as the proximity sensing means have detected the target.

In practice, Ve, $V_R$ and D are measured and the calculations necessary for a rate controlled by time t are made and a delay $T_1$, periodically renewed, is elaborated which will be used after detection of the target by the proximity sensing means, to trigger off the charge at the optimum instant.

The supplementary delay time t is preferably chosen to be proportional to the reciprocal of the square root of the relative speed $V_R$ and this supplementary delay time is calculated by said computing means.

Said computing means may be composed of a first circuit controlling the measurements of the different parameters and effecting the necessary calculations, of a second circuit determining the instant from which the duration of delay of explosion is exploitable and a third circuit allowing exploitation of this duration of delay. Such computing means may be constituted, at least in part, by a microprocessor.

The invention will be more readily understood on reading the following description with reference to the accompanying drawings, in which:

FIG. 1 is a general schematic view illustrating the way in which the air defence weapon system according to the invention is carried out.

FIG. 2 schematically shows an air defence missile according to the invention.

Figure 8:
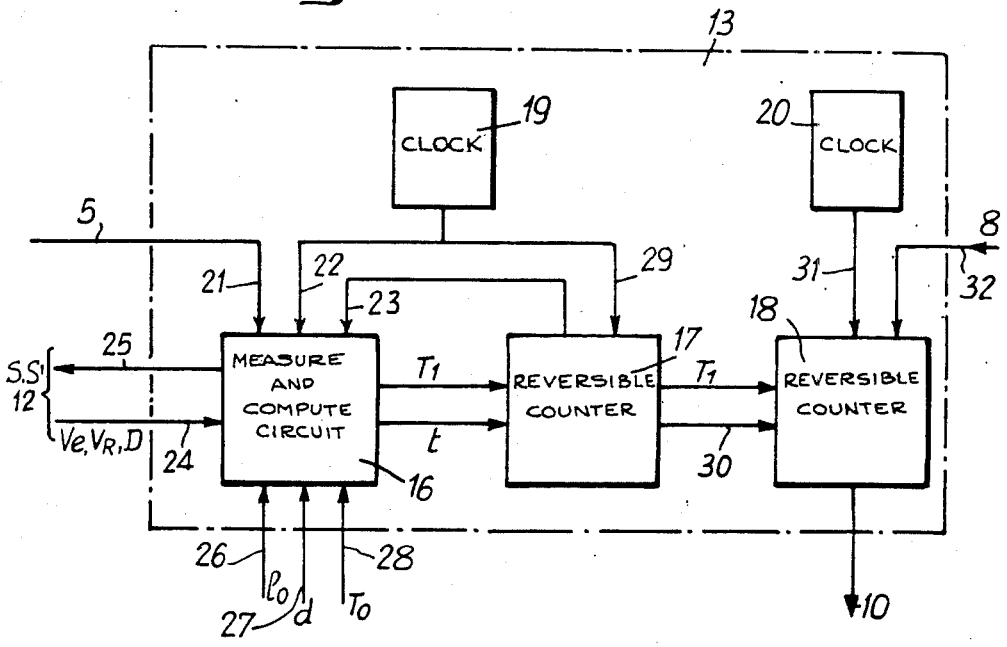

FIG. 8 gives the block diagram of the computing means of the system according to the invention, carried on board the missile.

Figure 1:
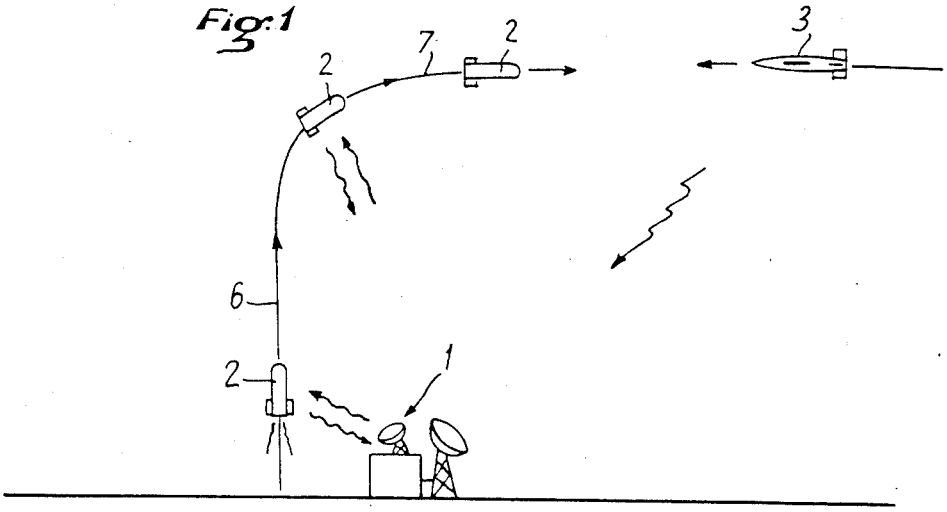

Referring now to the drawings, the weapon system according to the invention, shown in FIG. 1 and intended for air defence, comprises a detection and guiding device 1, located on the ground, as well as an assembly of air defence missiles 2. When an airborne enemy (missile, aircraft, helicopter, etc.) is detected by device 1, the latter determines, with the aid of the computer and the radar which it comprises, the opportuneness and conditions of an interception of the enemy 3.

Figure 2:
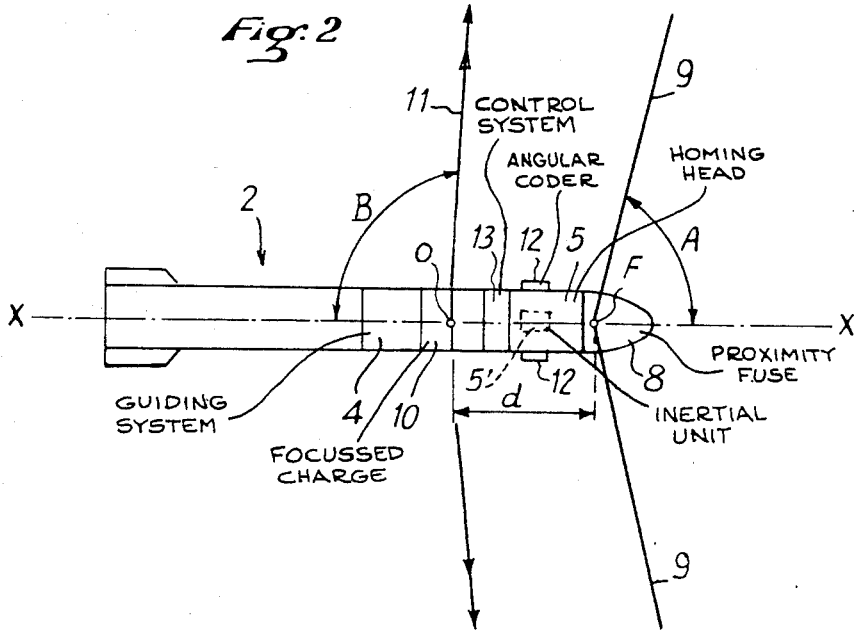
Figure 3:
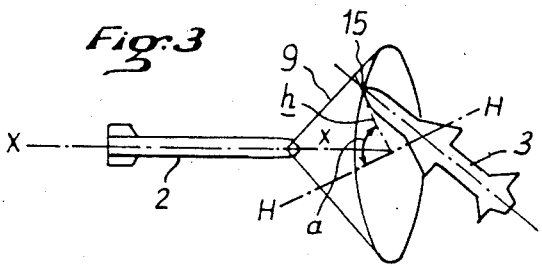
FIG. 3 is a schematic view showing two parameters intervening in the interception of a target by the missile according to the invention.

If interception is decided upon, the device 1 effects launching of a missile 2 against the enemy 3, which then becomes the target to be shot down. As shown schematically in FIG. 2, each air defence missile 2 comprises electronic guiding means 4 adapted to cooperate with the device 1 and a homing head 5 provided with an inertial unit 5'. At first, a missile 2 follows a launching trajectory entirely determined by the cooperation of the device 1 and the on-board guiding means 4. Then, still thanks to this cooperation, the device 1 directs the missile 2 towards the target 3, causing it to follow a trajectory 7. Finally, when the missile 2 is sufficiently well oriented, its guiding towards target 3 is taken over by its homing head 5.

Figure 4:
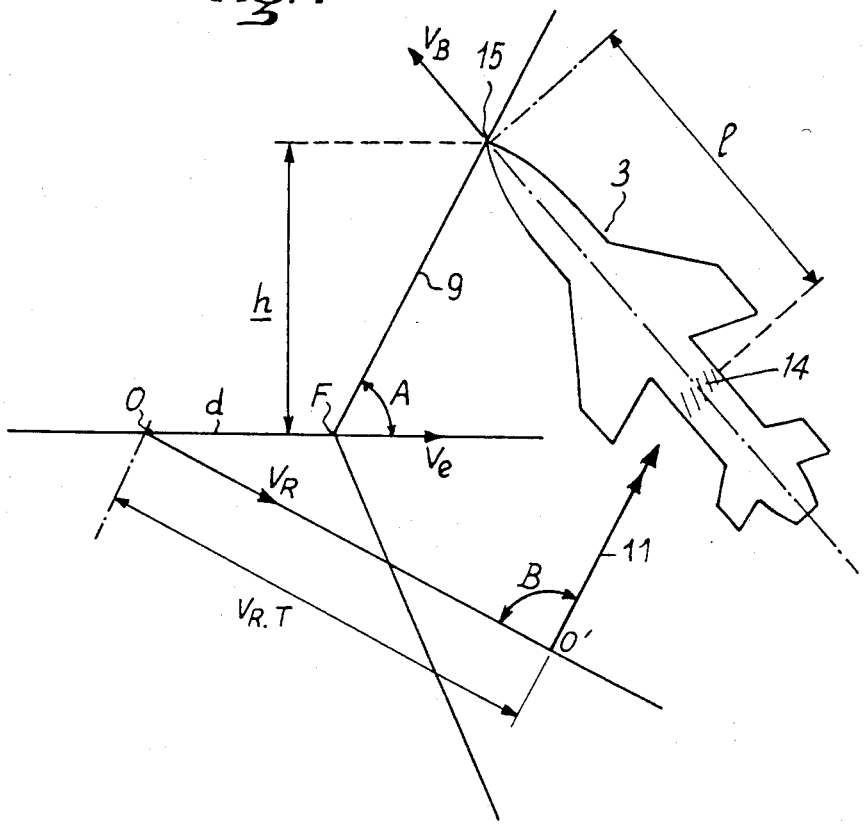
FIG. 4 is a diagram representing the interception of a target by the missile according to the invention, in the event of such interception being effected at the front of the target and of the target and the missile according to the invention lying in the same plane.
Figure 7:
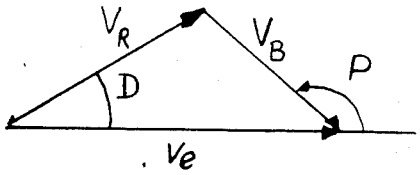
FIG. 7 is a diagram of velocities for the diagram of FIG. 6.
Figure 5:
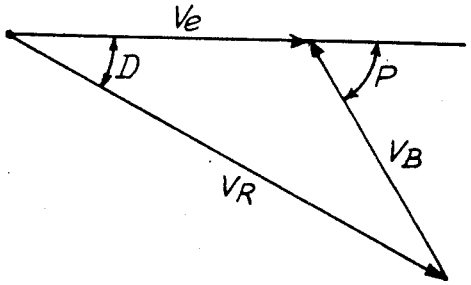
FIG. 5 is a diagram of velocities for the diagram of FIG. 4.
Figure 6:
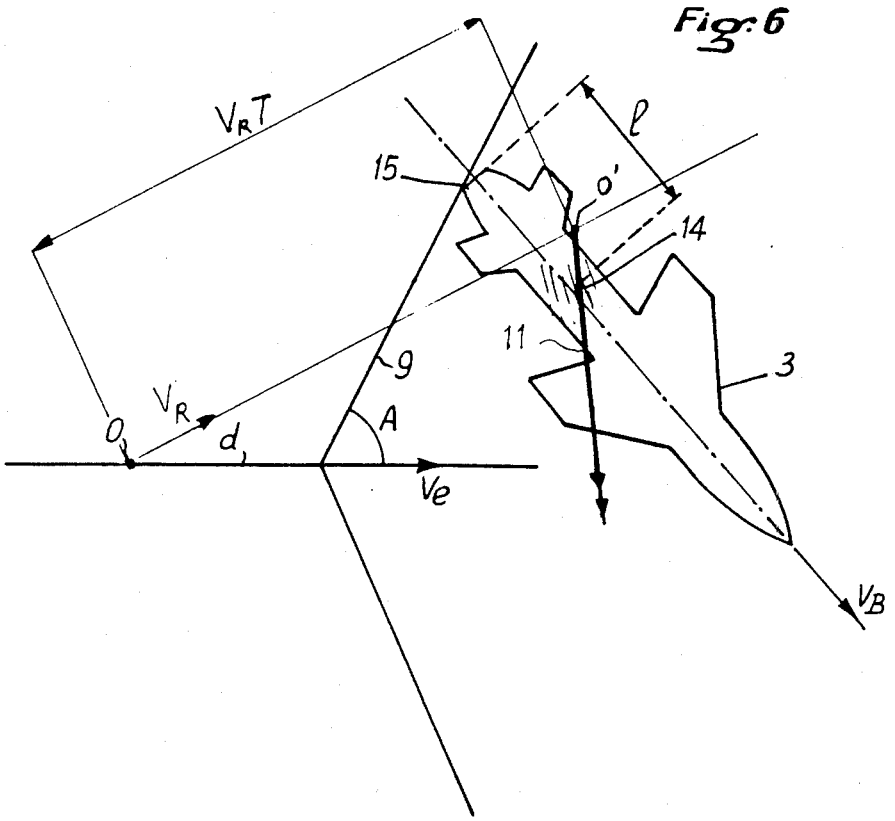
FIG. 6 is a diagram representing the interception of a target by the missile according to the invention in the event of such interception being made at the rear of the target and of the target and the missile according to the invention lying in the same plane.

It will be noted that FIG. 1 illustrates the case of the missile 2 meeting the target 3 and attacking it head-on, this corresponding to the diagrams of FIGS. 4 and 5. It is obvious that the missile 2 may also attack the target 3 from the rear, by tracking it and catching it up, as shown in the diagrams of FIGS. 6 and 7.

Each missile 2 comprises:

a proximity fuse 8 of which the detection front 9 is close to a concave conical surface with axis merging with the longitudinal axis X—X of said missile 2 and of vertex angle A;

a focussed payload 10 capable of projecting splinters over a surface of revolution of axis merged with the longitudinal axis X—X of the missile and of angle B;

angular coders 12 disposed on the frame of the homing head 5; and an electronic system 13 for controlling the focussed charge 10.

As specified hereinabove, the object of the invention is to control the explosion of the focussed charge 10 at an instant following detection of the target 3 by the proximity fuse 8, such that the splinters of said charge 10 reach a structurally fragile region of said target in order to cut said target into two. In general, the front and median parts of an attacking missile 3 are structurally resistant as they comprise the navigation and measuring apparatus, the fuel tanks, the payload, etc., with the result that, to obtain structural destruction of said missile 3, it is preferable to project the splinters of the charge 10 into a zone 14 of the rear part thereof (cf. FIGS. 4 and 6). The object of the invention is thus to determine a time T of delay of the explosion of the charge 10, after the detection of the target 3 by the proximity fuse 8, such that the splinters of said focussed charge 10 can reach zone 14, located at a distance l from the first point 15 of the target 3 detected by the front 9 of said proximity fuse 8.

It will be noted that the explosion of the charge 10 after firing by electronic system 13 is not instantaneous and that, moreover, there is a delay of detection of a target 3 by the proximity fuse 8; consequently, the time T of delay of the explosion must be corrected by a time To, known for a given charge 10 and proximity fuse 8 and corresponding to the delays of explosion after firing and of detection by the proximity fuse 8.

In fact, the instant of firing control must intervene with a delay time:

$$T1 = T - To$$

If it is desired mathematically to determine the distance l between the first point detected 15 and the zone 14, at least the following parameters must be taken into account:

the velocity Ve of the air defence missile 2;

the velocity VB of the target 3;

the angle P of the presentation of the target 3 with respect to the missile 2, i.e. the angle between the direction of the velocity Ve and that of the velocity VB (cf. FIGS. 5 and 7);

the time T of delay of the explosion of the focussed charge 10 after detection of point 15 of the target 3 by the front 9 of the proximity fuse 8;

the velocity Vi of the splinters of the focussed charge 10, projected over the surface of revolution 11;

the angle B of the surface of revolution 11 with respect to the axis X—X of the missile 2;

the angle A of the detection front 9 of the proximity fuse 8, with respect to the axis X—X of the missile 2;

the distance d along the axis X—X of the missile 2, between the centre F of the proximity fuse 8 and the centre O of the focussed charge 10;

the axial position h of point 15 of the target 3 detected by the proximity fuse 8, with respect to the axis X—X of the missile 2; and the angle a defining the angular position of said point 15 for example with respect to the perpendicular direction H—H common to Ve and $V_B$ (in FIGS. 4 and 5, a=90°).

It is obvious that, by knowing at the instant of detection of point 15 by the front 9, all the above parameters, except for T, T may be calculated for l to have a value given in advance. It is therefore possible theoretically to reach a predetermined zone 14, at least when the calculation of $T_1$ gives a positive result. However, in practice, such a calculation of T is not possible because, although certain parameters such as Vi, A, B and d are known by construction and others, such as Ve, $V_B$ and P may be measured on the missile 2 at instants close to interception, there is still considerable uncertainty as h and a are not known.

The present invention overcomes this difficulty. In fact, Applicants have demonstrated, by studying the quantity l, function of the preceding ten parameters, that said quantity could be written in the form of a sum of three terms $$l = lo + Dl_1 + Dl_2$$

viz.

lo is a constant, having the dimension of a length and independent of the parameters Ve, $V_B$ and P; lo is attached to each type of target 3 and characteristic thereof. The detection and guiding device 1, which effects an at least partial image recognition of the target 3, knows the type of said target and may therefore address to the electronic system 13 of the missile 2 the value lo appropriate for the target 3 in the course of interception. The different values lo corresponding respectively to the different types of targets possible are preferably predetermined and stored in the device 1. With each type of target 3 there may be associated a value of lo for an attack from the front and another value lo for an attack from the rear. The missile 2 may possibly comprise the means for detecting the type of target 3 and determining the value to be adopted for the constant lo;

$Dl_1 = \pm V_B \cdot te$, term in which te is the time taken by the splinters of the focussed charge 10 to reach the zone 14 of the target 3. The + sign is used for an attack from the front and the − sign for an attack from the rear. The detection and guiding device 1 knows the type of attack (from the front or the rear) which the missile 2 will make on target 3 and it is therefore in a position to communicate to the electronic system 13 the appropriate sign. It will be noted that te is an implicit function of h, a and T; and $Dl_2$ is a variation in length due to the parameters h and a.

The condition for l to be considered as the sum of terms lo, $Dl_1$ and $Dl_2$ is in that case the following:

$$\frac{1}{tgA} + \frac{1}{tgB} = \frac{Ve}{Vi} \quad (1)$$

Condition (1) is easy to make by construction, since only parameters at the disposal of the constructor of missile 2 intervene. If this condition (1) is respected, the delay time T is given by the formula:

$$T = \frac{d + lo \cos P}{Ve + V_b \cos P} \text{ if } \cos P > 0 \quad (211)$$

i.e. if the attack is made head-on (cf. FIGS. 4 and 5), or by formula:

$$T = \frac{d - lo \cos P}{Ve + V_B \cos P} \text{ if } \cos P < 0, \quad (2!2)$$

i.e. if the attack is made from the rear (cf. FIGS. 6 and 7).

Moreover, Applicants have shown that if the relation (1) were verified at least with a good approximation, the term $Dl_2$ remained small before lo and $Dl_1$, at least in an extensive range of the parameters Ve, $V_B$ and P and could therefore be ignored.

In this way, if condition (1) is respected and if the time T has been chosen depending on the appropriate relation ($2_1$) or ($2_2$), the zone 14 reached by the splinters will be defined from point 15 by the relation:

$$l = lo \pm V_B \cdot te \quad (3)$$

Consequently, if, as a function of the diameter of the zone covered by the proximity fuse 8 and of considerations of effectiveness of structural destruction, a maximum time $t_M$ of path of the splinters of the focussed charge 10 is chosen, a high probability of touching the target 3 in a zone defined between lo and $lo \pm V_B \cdot t_M$ is obtained.

It will be noted that the calculation of T may easily be effected on board the missile 2. In fact, as shown in FIGS. 5 and 7, $$V_R \cos D = Ve + V_B \cos P$$

$$V_R \sin D = V_B \sin P$$

$V_R$ being the relative velocity of the target 3 with respect to the missile 2 and D the angle between the velocity Ve of the missile and this relative velocity $V_R$.

Consequently, $$T = \frac{d \pm lo \cos P}{-V_R \cos D}$$

$$\text{with } tg\, P = \frac{V_R \sin D}{V_R \cos D - Ve}$$

The time T therefore depends solely on the three variables $V_R$, Ve and D, since d and lo are fixed either by construction (d) or by predetermination (lo). Now:

- $V_R$ is available from the homing head 5 which comprises for example a Doppler effect radar. The relative velocity $V_R$ is a datum always present on board a missile 2, as it is necessary for elaborating the guiding in proportional navigation by means of the homing head 5;
- Ve may be known in several different ways, for example from the inertial unit 5' of the homing head 5 of the missile 2 of from accelerometers; it might also be tabulated as a function of the path time taken by said missile 2;
- the angle D is given by the angular coders 12 disposed on the frame of the homing head 5; such coders are generally provided on the missile 2 because of the necessity of previously orienting the latter (trajectory 7) before the target 3 can be latched by the homing head 5.

FIGS. 4 and 6 schematically illustrate a front interception and a rear interception and they show that, at the instant of the explosion of the focussed charge 10, the center O thereof lies at O' so that the focussed splinters 11 can reach the predetermined zone 14.

FIG. 8 shows an embodiment of the electronic system 13 for controlling the focussed charge 10. This device 13 is constituted by a measuring and computing circuit 16 and by two reversible counters 17 and 18, as well as by two clocks 19 and 20 emitting pulses at respective rates $c_1$ and $c_2$.

Circuit 16 controls the measurements and effects the calculations. The reversible counter 17 determines the instant from which the delay time of the explosion is exploitable, whilst the reversible counter 18 allows exploitation of this delay.

Circuit 16 comprises three inputs 21, 22 and 23 respectively connected to the homing head 5, to the clock 19 and to the reversible counter 17, as well as an input 24 and an output 25 connected to the sensors 5, 5', 12 and three inputs 26, 27 and 28, respectively for parameters lo, d and To. It is put to use when the following conditions are complied with:

- on input 21, the homing head 5 applies a signal indicating that it is functioning and that it has latched on the target 3;
- on input 22, a pulse of clock 19 is present;
- the circuit 17 addresses an authorization to measure on input 23.

Circuit 16 then successively provokes:

- reading of Ve, $V_R$ and D on sensors 5, 5' and 12 by input 24;
- calculation of the time $T_1$ of delay of firing and of the supplementary delay time t;
- loading of the reversible counter 17 by the delay time t;
- authorization to decrement this reversible counter 17;
- memorization of the delay time $T_1$.

The reversible counter 17 is initialized to the number of pulses $$N_1 = \frac{t}{cl} - 1.$$

Its loading by circuit 16 provokes inhibition of measurement of the latter by input 23. The reversible counter 17 is decremented by 1 upon each pulse of clock 19 (link 29). When its contents become negative, the following operations are carried out:

- initialization of the reversible counter 18 (link 30);
- loading of $T_1$ in the reversible counter 18;
- authorization of measurement on input 23, to unlock circuit 16.

Reversible counter 18 is initialized by reversible counter 17 to a number of pulses $$N_2 = \frac{T1}{c2} - 1.$$

It is decremented by 1 upon each pulse of clock 20 (link 31) as soon as the proximity fuse 8 detects the target 3 and addresses a corresponding signal to reversible counter 18 by link 32. When its contents are negative, the explosive charge 10 is fired.

The measurement authorization signal (input 23) is initialized at the moment of launching or during tracking of the homing head 5.

It will be noted that this system makes it possible to conserve the last known value of T if the homing head 5 loses the target 3. If the calculation of T leads to a negative number, the delay of explosion is zero after detection of the target 3 by the proximity fuse 8.

What is claimed is:

1. A weapon system intended for the structural destruction of a target by means of a controlled focussed charge having splinters and comprising a missile carrying said focussed charge and carrying first means for furnishing the value of the velocity Ve of said missile, second means for furnishing the value of the vectorial relative velocity $V_R$ of the target with respect to said missile, third means for furnishing the angle D between the longitudinal axis of the missile and said relative velocity, and fourth means for detecting proximity, adapted to indicate the instant of detection of one end of said target, wherein said system comprises computing means which are mounted on board said missile and which, from the values of the velocity of the missile and of the relative target-missile velocity, as well as from said angle between the longitidinal axis of the missile and said relative velocity, calculate at an instant close to said instant of detection furnished by said fourth means, a duration which is then counted down by said computer means from said instant of detection and at the end of which said computer means control said focussed charge.

2. The weapon system of claim 1, in which said first, second and third means furnish their information continuously, wherein said computing means calculate said duration continuously and furnish a series of values thereof, and, from said instant of detection furnished by said fourth means, said computing means count-down the last value of this duration available before said instant of detection.

3. The weapon system of claim 1 wherein said computing means calculate the duration T from the following formulae:

$$T = \frac{d + |lo \cos P|}{V_R \cos D} \text{ and } tg\, P = \frac{V_R \sin D}{V_R \cos D - Ve}$$

in which:

T = duration counted down from the instant of detection of one end of the target by said fourth means and at the end of which the explosion of the focussed charge is desired for its splinters to reach a predetermined vulnerable part of said target;

d = distance separating, along axis X—X of the missile, the centre F of the fourth proximity sensing means from the center O of the focussed charge;

lo = constant, homogeneous to a length, characteristic of the target to be destroyed;

Ve = velocity of the missile;

$V_R$ = vectorial relative velocity of the target with respect to the missile;

D = angle between the axis of the missile and $V_R$.

4. The weapon system of claim 1, in which at least one of said computing means and said proximity sensing means presents a delay inherent in the explosion of said focussed charge and in the detection of a target, respectively, wherein, if the totality of these known delays inherent in the system is equal to To, said computing means address to the focussed charge a firing signal at the end of a duration $T_1$, which is equal to the difference between the duration T, at the end of which the explosion of the focussed charge is desired, and the duration of delay To.

5. The weapon system of claim 3, wherein it comprises means adapted to recognize the type of the target and to furnish the constant lo.

6. The weapon system of claim 2, wherein the value of the duration (T or $T_1$) applicable at a given instant is calculated from measurements of the velocity Ve of the missile, of the relative target-missile velocity $V_R$ and of the angle D, made at an earlier instant, and said computing means elaborate an additional delay time t which is counted down from the instant of said measurements and of which the expiration allows the beginning of the count-down of the delay (T or T1) of firing of the charge, as soon as the proximity sensing means have detected the target.

7. The weapon system of claim 6, wherein said supplementary delay time t is calculated by said computing means and is proportional to the reciprocal of the square root of the relative velocity $V_R$.

8. The weapon system of claim 6, wherein said computing means are composed of a first circuit controlling the measurements of the different parameters and effecting the necessary calculations, of a second circuit determining the instant from which the duration of delay (T or $T_1$) is exploitable and a third circuit allowing exploitation of this duration of delay (T or $T_1$).

* * * * *